US006260514B1

(12) United States Patent
Ehling et al.

(10) Patent No.: US 6,260,514 B1
(45) Date of Patent: Jul. 17, 2001

(54) VAPORIZER HAVING A REVISED BOILING CHAMBER GEOMETRY

(75) Inventors: Peter Ehling, Chicago; Peter Delmenico, Evanston; Les Dobrzanski, Berwyn; James G. Montagnino, St. Charles, all of IL (US)

(73) Assignee: Sunbeam Products, Inc., Boca Raton, FL (US)

( * ) Notice: Subject to any disclaimer, the term of this patent is extended or adjusted under 35 U.S.C. 154(b) by 0 days.

(21) Appl. No.: 09/482,727

(22) Filed: Jan. 13, 2000

(51) Int. Cl.[7] ..... F22B 37/48
(52) U.S. Cl. ..... 122/386; 122/394; 392/337
(58) Field of Search ..... 122/13.01, 19.2, 122/235.23, 386, 393, 394; 392/336, 337

(56) References Cited

U.S. PATENT DOCUMENTS

| | | | | |
|---|---|---|---|---|
| 184,948 | * | 12/1876 | Adgate et al. | 122/394 |
| 335,559 | * | 2/1886 | Bowers | 122/394 |
| 2,733,693 | * | 2/1956 | Johnsson | 122/394 |
| 2,804,056 | * | 8/1957 | Whiting | 122/19.2 |
| 2,847,549 | * | 8/1958 | Schmitt et al. | 392/337 |
| 3,521,604 | * | 7/1970 | Nickel | 122/19.2 |
| 4,463,248 | * | 7/1984 | Katzman et al. | 392/337 |
| 5,134,683 | * | 7/1992 | Powell | 392/449 |

* cited by examiner

*Primary Examiner*—Gregory Wilson
(74) *Attorney, Agent, or Firm*—Kramer, Levin, Naftalis & Frankel LLP

(57) ABSTRACT

A revised boiling chamber geometry in a vaporizer provides a scale collection area which prevents occlusion of the water inlet. A detachable scale collection cup allows for easy removal and cleaning of the cup.

17 Claims, 4 Drawing Sheets

VAPORIZER HAVING A REVISED BOILING CHAMBER GEOMETRY

FIELD OF THE INVENTION

The present invention relates to vaporizers, more specifically to a vaporizer having a boiling chamber shape which includes scale collection areas. In addition the present invention relates to a vaporizer having a detachable scale collection cup.

BACKGROUND INFORMATION

A vaporizer provides steam or moist air to a room by heating and thus evaporating water. This may be done to make a room more comfortable and to provide a healthier environment.

A typical vaporizer includes a reservoir for holding water and an evaporation chamber (also called a heating unit or boiling chamber) for accepting water from the reservoir. The evaporation chamber includes two electrodes, commonly manufactured from stainless steel, which may be, for example, flat plates, one inch wide and four inches long, which typically are separated by a distance of approximately one half inch. Each electrode may be connected directly to one lead of a conventional 120 volt household electric current supply. The electrodes are partially submerged by water supplied from the reservoir, and electric current flowing between the electrodes and through the water heats the water to the point of boiling. Steam and water vapor are formed and flow out of a hole in the boiling chamber to the surrounding air, humidifying the surrounding air. The boiling chamber concentrates heat provided by the electrodes in a space which is smaller than the entire boiling chamber, providing for faster boiling.

The water in the reservoir is usually supplied from a water tank or reservoir through a water supply hole in the bottom of the boiling chamber. The water supplied to the boiling chamber usually contains significant amounts of a variety of dissolved solids and minerals. These dissolved solids and minerals remain in the boiling chamber as the water evaporates, and gradually collect on the electrodes and in the chamber as a white, flaky powder generally called scale. As the scale formation becomes more pronounced over time, scales become detached from the electrodes and settle on the bottom of the reservoir. This scale may eventually occlude the water intake hole located in the bottom of the reservoir thereby restricting the flow of water into the chamber and consequently disrupting the ability of the vaporizer to generate steam.

In the past, manufacturers have provided instructions to vaporizer consumers to remove scale buildup by periodically washing the boiling chamber and electrodes. One recommended method is soaking the electrodes and boiling chamber in vinegar. This maintenance is a barrier to the use of such vaporizers. This maintenance also may pose a safety hazard. Typically, a lid or cover may be opened so that the user may access the boiling chamber. Opening this lid typically disables the delivery of current to the boiling chamber, which is a safety necessity, given that the electrodes receive 120V from the home electrical supply. However, such safety systems may work imperfectly or may be defeated.

Furthermore, some consumers simply do not wash the boiling chamber. In such a case the water intake hole becomes occluded and the vaporizer soon ceases to work, resulting in consumer dissatisfaction.

Therefore, there exists a need for a vaporizer which requires less maintenance than prior art vaporizers.

Furthermore, there exists a need for a vaporizer which may be easily and safely maintained.

SUMMARY OF THE INVENTION

An exemplary embodiment of the present invention overcomes the above-described problems by providing a unique boiling chamber geometry which includes a scale collection area. The water intake hole is located away from the scale collection area, thus eliminating or greatly reducing the potential for occlusion of the water intake hole and consequently reducing the need to clean the boiling chamber.

In an alternate exemplary embodiment, a scale collection cup is provided which is easily detachable from the boiling chamber eliminating, or at least greatly reducing, the need to remove the boiling chamber for cleaning.

DETAILED DESCRIPTION OF THE INVENTION

An exemplary embodiment of the present invention provides a vaporizer in which the boiling chamber has a collection area in which scales can settle without interfering with the boiling chamber water inlet. In an alternate exemplary embodiment, the boiling chamber has a scale collection cup which can be quickly and easily removed and cleaned thereby preventing scale buildup from interfering with the operation of the vaporizer.

In the following description, various aspects of the present invention will be described. For purposes of explanation, specific configurations and details are set forth in order to provide a thorough understanding of the present invention. However, it will also be apparent to one skilled in the art that the present invention may be practiced without the specific details. Furthermore, well known features often are omitted or simplified in order not to obscure the present invention.

Figure 1A:
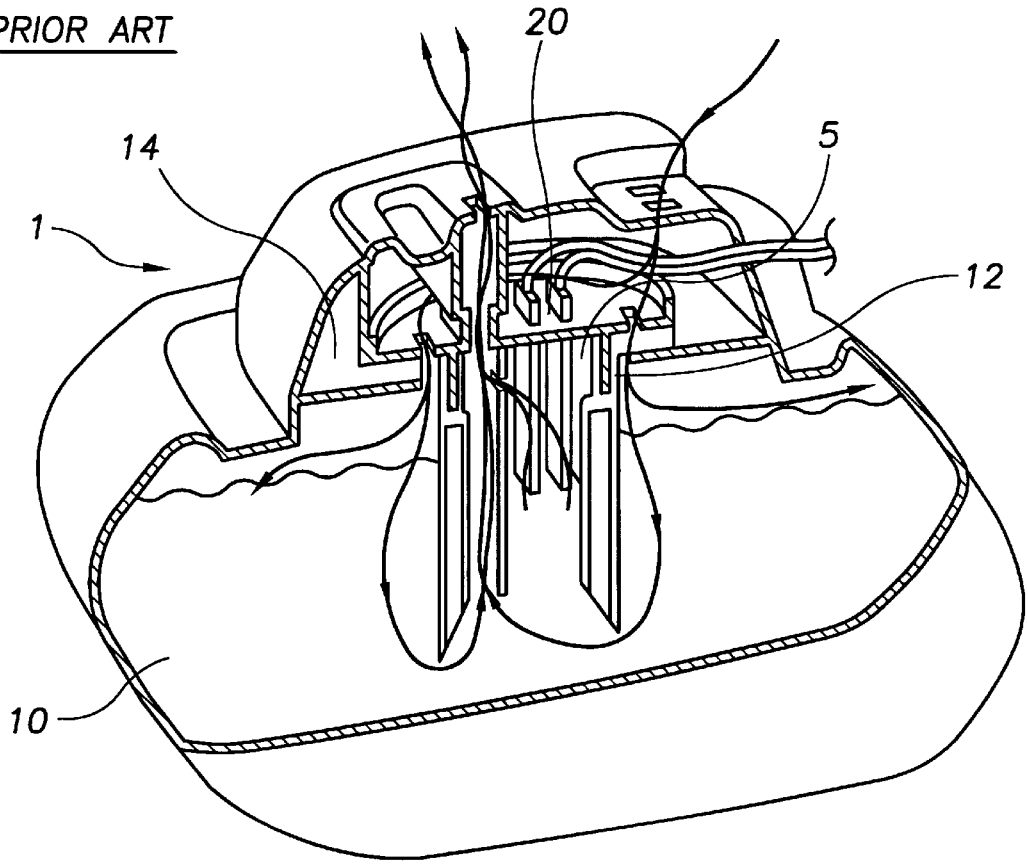
FIG. 1A PRIOR ART
FIG. 1A is illustrates a conventional vaporizer.

FIG. 1A depicts a conventional vaporizer 1. A conventional vaporizer 1 typically includes a reservoir 10 for holding water having an opening 12 on top for accepting a vaporizing unit 5. The vaporizing unit 5 includes a head unit 20, which may fit into the opening 12 of the vaporizer and a boiling chamber 100. The head unit 5 may rest on an annular ledge 14 of the reservoir 10, for supporting the boiling chamber 100.

Figure 1B:
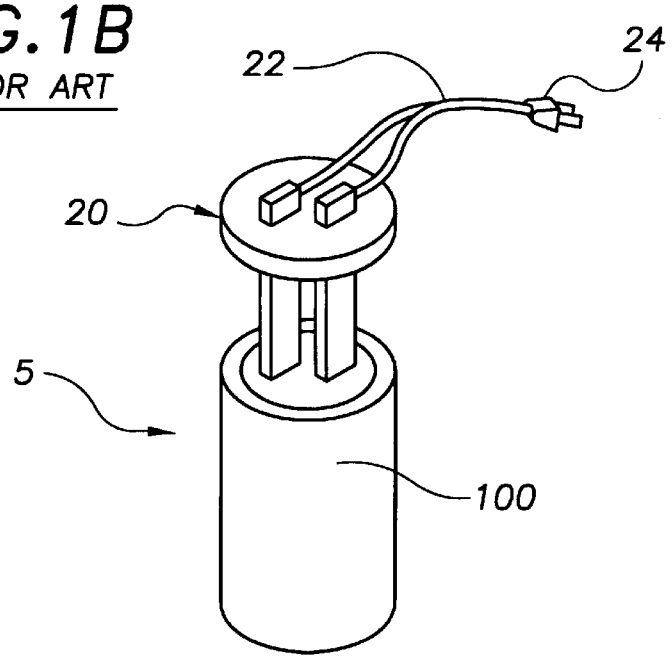
FIG. 1B PRIOR ART
FIG. 1B illustrates a conventional boiling chamber and head unit.

In FIG. 1B, the head unit 20 has been partially removed from the boiling chamber 100. The head unit 20 may include a power cord 22, which attaches to a conventional 120 volt home power supply via a standard two or three-pronged plug 24.

For purposes of simplicity and clarity FIGS. 1C, 2, 3, 4A, 4B and 5 illustrate a boiling chamber 100 without showing the head unit 20, power cord 22, or plug 24.

Figure 1C:
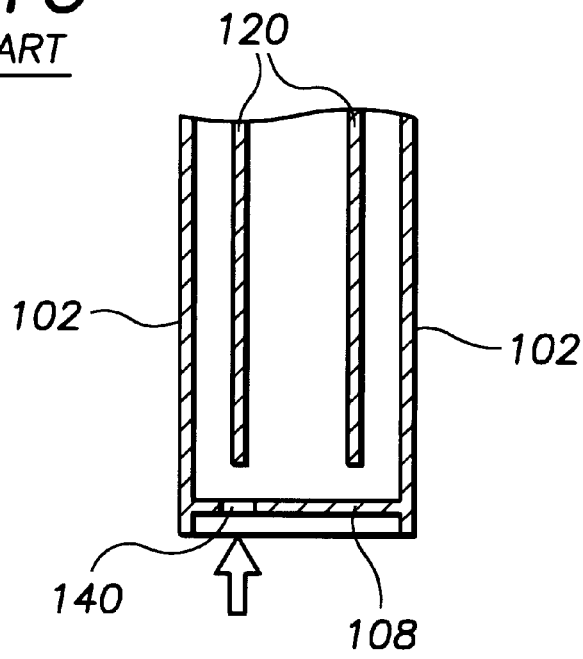
FIG. 1C PRIOR ART
FIG. 1C illustrates a cross-sectional view of a vaporizer unit having a conventional boiling chamber geometry.

FIG. 1C is a cross-sectional view of the boiling chamber of FIG. 1B. A conventional vaporizer comprises a boiling chamber 100 which extends downward from the head unit 20 (FIG. 1A) for vaporizing the water supplied by the reservoir 10 (FIG. 1A). The boiling chamber 100 provides a generally rectangular opening formed by a set of side walls 102 and a bottom wall 108. The boiling chamber 100 may include an outer insulating wall (not shown) connected to the boiling chamber 100. Thus, the general external shape of the boiling chamber 100 including the outer insulating wall, if present, may be conical or may have other desired configurations. When the boiling chamber 100 is inserted properly into the water filled reservoir 10, the outer insulating wall and the set of side walls 102 define an air filled insulating area which is open at the bottom and closed at the top.

Two electrodes 120 extend downward inside the boiling chamber 100 from the head unit 20. The electrodes 120 may be, for example flat stainless steel plates, one inch wide and four inches long, which are parallel and separated by a distance of approximately one half inch. The bottom wall 108 of the boiling chamber 100 includes a water intake opening 140 for allowing water to flow from the reservoir 10 into the boiling chamber 100.

As water is evaporated from the boiling chamber 100, minerals contained in the water stay behind in the boiling chamber 100, and form scale on the electrodes 120 and on the inside of the boiling chamber 100. After a period of time scale which becomes detached from the electrodes 120 will settle along the bottom wall 108 of the boiling chamber and occlude the water intake opening 140.

Figure 2:
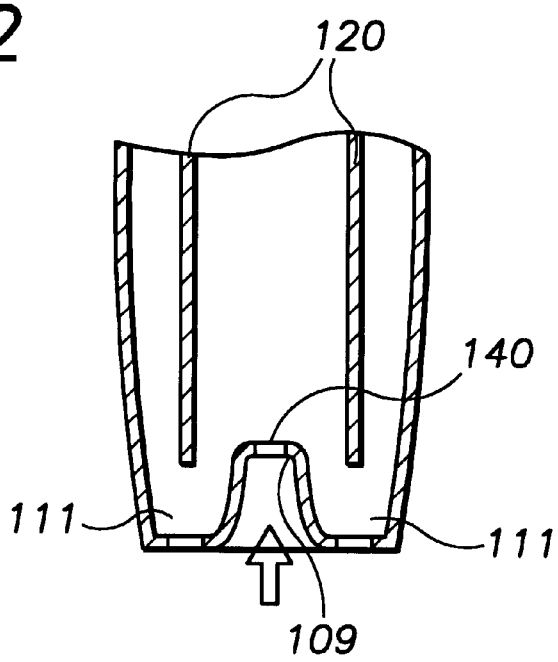
FIG. 2 illustrates a cross-sectional view of one exemplary embodiment of the present invention in which a vaporizer has a boiling chamber with a scale collection area.

FIG. 2 illustrates a cross-sectional view of an exemplary embodiment of the present invention. As shown in FIG. 2, bottom wall 108 is not flat but rather contains a raised central portion 109 which creates a scale collection area 111 due to the depression around the periphery of the raised central portion 109. The raised central portion 109 is preferably in the shape of a curved dome. Preferably, the highest portion of the raised central portion 109 is close to or somewhat above the level corresponding to the lower end of the electrodes 120. The water intake opening 140 is located, for example, near the highest point of the raised central portion 109. The water intake opening 140 alternatively may be located along the side of the raised central portion 109. Since the water intake opening 140 is located away from the scale collection area 111, occlusion of the water intake opening 140 is prevented.

Figure 3:
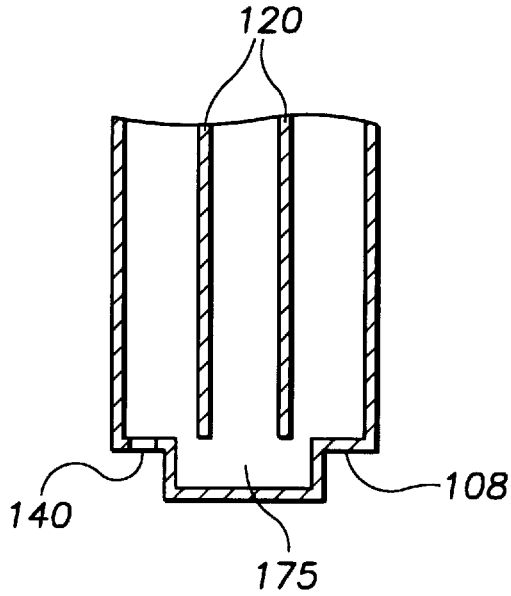
FIG. 3 illustrates a cross-sectional view of an alternate exemplary embodiment of the present invention of a scale collection area within a boiling chamber.

FIG. 3 illustrates a cross-sectional view of an alternate exemplary embodiment of the present invention. As shown in FIG. 3 the bottom wall 108 of the boiling chamber 100 contains a central depression 175. The diameter of the central depression is preferably in the range of approximately one to two inches, so that the ends of the electrodes will be located above the central depression 175. The depth of the central depression 175 is approximately one inch, preferably less. The water intake opening 140 is preferably located along the portion of the bottom wall 108 which does not form the central depression 175. This arrangement of electrodes 120, central depression 175, and water intake opening 140 allows a significant amount of scale to collect in the central depression 175 while keeping the water intake opening 140 free of scale. Thus, scale may continue to detach from the electrodes 120, and collect in the central depression 175 without interfering with the operation of the vaporizer. When scale fills the central depression 175, the boiling chamber 100 should be removed and cleaned as described above.

Figure 4A:
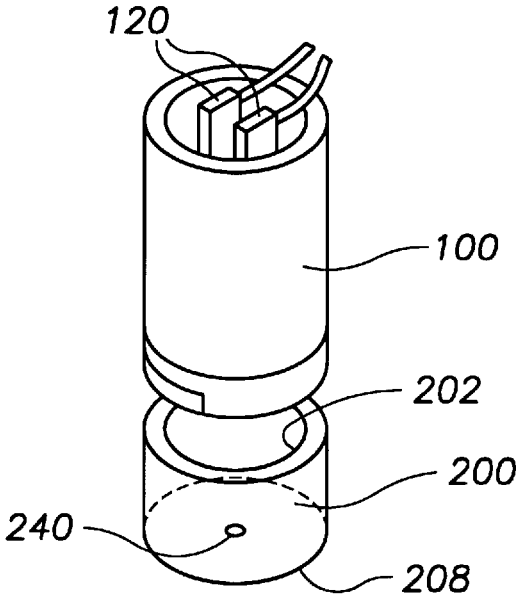
FIG. 4A illustrates a vaporizer having a scale collection cup which is detachable from the boiling chamber according to an exemplary embodiment of the present invention.

FIG. 4A illustrates an alternate exemplary embodiment of the present invention. As shown in FIG. 4A, the vaporizer comprises a boiling chamber having a detachable scale collection cup 200. The detachable scale collection cup 200 allows scale to collect in the bottom of the cup 200 and for the cup to be easily detached, cleaned, and reattached for continued use. Preferably, the collection cup 200 is attached and detached using a snap fitting or quarter turn threading. However, any suitable attachment and detachment means may be used. For example, other forms of threading, clamping or combinations thereof may be utilized.

The collection cup 200 preferably has a side wall 202 and a bottom wall 208. A water intake opening 240 is located in the bottom wall 208, but also could be located in side wall 202. The diameter of the collection cup will preferably correspond to the diameter of the main portion of the boiling chamber 100. The distal ends of the electrodes 120 preferably are located less than one inch and preferably approximately ¾ inch from the bottom of the collection cup near the level where the collection cup 200 attaches to the main portion of the boiling chamber 100. The water intake opening 240 preferably is located near the center of the bottom wall 208 of the collection cup 200. The bottom wall 208 of the collection cup 200 may be flat so that it forms a perpendicular angle with the side wall 202.

Figure 4B:
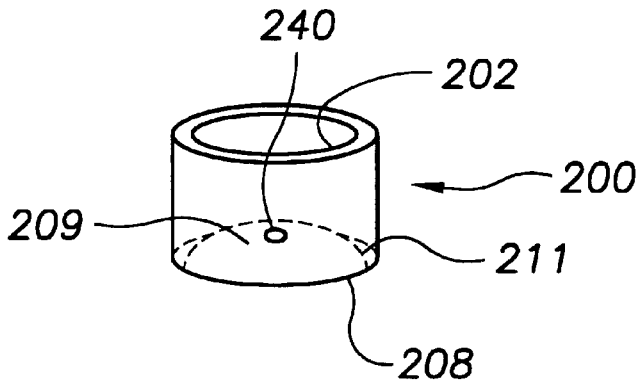
FIG. 4B illustrates a vaporizer having an exemplary alternate embodiment of a detachable scale collection cup.

As shown in FIG. 4B in an alternate exemplary embodiment, the bottom wall 208 of the detachable collection cup 200 may have a raised central area 209 which forms a scale collection area 211 around its periphery. The water intake opening 240 may be located, for example, near the highest point of the raised central portion 209. The water intake opening 240 alternatively may be located along the side of the raised central portion 209 or in sidewall 202. Since the water intake opening 240 is located away from the scale collection area 211, occlusion of the water intake opening 240 is prevented.

Figure 5:
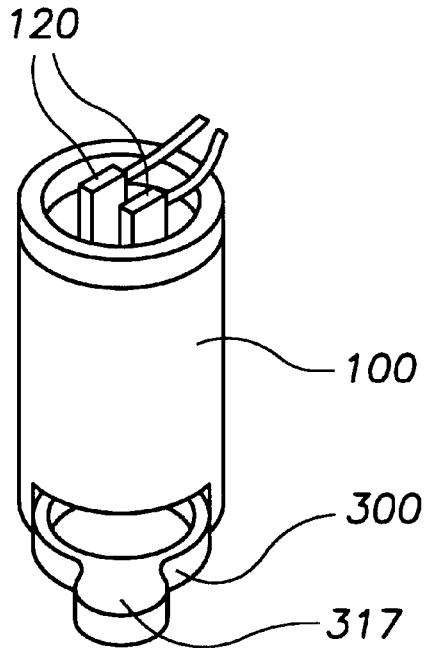
FIG. 5 illustrates a vaporizer having an alternate embodiment of a detachable scale collection cup according to an exemplary embodiment of the present invention.

FIG. 5 illustrates an alternate exemplary embodiment of a detachable scale collection cup 300. As shown in FIG. 5, the scale collection cup 300 fits into a slot formed at the base of the boiling chamber 100. To facilitate insertion and removal of the scale collection cup, a tab 317 is formed on the periphery of the cup 300. The diameter of the scale collection cup 300 will approximate the diameter of the boiling chamber 100 to provide a water-tight seal between the cup 300 and the boiling chamber 100.

Preferably, most of the non-electrical parts of the vaporizer, for example the non-electrical parts of the boiling chamber, including detachable scale collection cups are formed from plastic such as polypropylene or polyethylene which can withstand the heat of boiling water without deforming.

While the system and method of the present invention is described with respect to specific embodiments, it should be noted that the invention may be implemented in different manners and used with different applications. For example, although the typical structure and components of a conventional vaporizer have been described herein with reference to FIGS. 1A, 1B, and 1C, it should be noted that the present invention may be incorporated into any vaporizer, whether or not such vaporizer comprises each feature described in FIGS. 1A, 1B, and 1C.

What is claimed is:

1. A vaporizer comprising:

a water reservoir;

a boiling chamber disposed in the water reservoir, the boiling chamber having a partially raised bottom portion including a water inlet; and a scale collection area surrounding the partially raised bottom portion.

2. The vaporizer of claim 1 wherein the partially raised bottom portion is a curved dome, and wherein the water inlet is located substantially near the top of the dome.

3. The vaporizer of claim 2 comprising a set of electrodes.

4. The vaporizer of claim 1 wherein the partially raised bottom portion is a curved dome.

5. The vaporizer of claim 1 wherein the boiling chamber is removable.

6. The vaporizer of claim 1 wherein a lower portion of the boiling chamber including the partially raised bottom portion is detachable from an upper portion of the boiling chamber.

7. A vaporizer comprising:

a water reservoir;

a boiling chamber disposed in the water reservoir, the boiling chamber including a set of electrodes and having a partially lowered bottom portion and a water inlet disposed above a lower surface of the partially lowered bottom portion; and a scale collection area disposed in the partially lowered bottom portion.

8. The vaporizer of claim 7 wherein a lower portion of the boiling chamber including the partially lowered bottom portion is detachable from an upper portion of the boiling chamber.

9. A vaporizer comprising:

a water reservoir;

a boiling chamber disposed in the water reservoir, the boiling chamber including a set of electrodes; and a scale collection cup extending below the boiling chamber, having a water inlet.

10. The vaporizer of claim 9 wherein the scale collection cup is detachable from the boiling chamber.

11. A vaporizer comprising:

a water reservoir; and a boiling chamber disposed in the water reservoir, the boiling chamber including at least a bottom portion, the bottom portion including at least:

a lower section;

a raised section extending upward from the lower section; and a water inlet.

12. The vaporizer of claim 11 wherein the bottom portion of the boiling chamber is detachable from an upper portion of the boiling chamber.

13. The vaporizer of claim 11 wherein the raised section is a dome.

14. The vaporizer of claim 11 comprising a set of electrodes.

15. The vaporizer of claim 11 comprising a scale collection area disposed on the lower section.

16. The vaporizer of claim 11 wherein the boiling chamber is removable.

17. The vaporizer of claim 11 wherein the water inlet is disposed on the raised section.

* * * * *